US008205650B2

(12) United States Patent
Zinniger et al.

(10) Patent No.: US 8,205,650 B2
(45) Date of Patent: Jun. 26, 2012

(54) CLAMPING ASSEMBLY FOR WOODWORKING KNIFE

(75) Inventors: Ian G. Zinniger, Ste-Therese (CA); Mathieu J. A. Gouin, Blainville (CA); Daniel M. LaGrange, Kelowna (CA)

(73) Assignee: Iggesund Tools AB, Iggesund (SE)

( * ) Notice: Subject to any disclaimer, the term of this patent is extended or adjusted under 35 U.S.C. 154(b) by 733 days.

(21) Appl. No.: 11/794,241

(22) PCT Filed: Jan. 5, 2006

(86) PCT No.: PCT/SE2006/000012

§ 371 (c)(1),
(2), (4) Date: Jan. 14, 2008

(87) PCT Pub. No.: WO2006/073362

PCT Pub. Date: Jul. 13, 2006

(65) Prior Publication Data

US 2009/0129875 A1 May 21, 2009

(51) Int. Cl.
*B27C 1/00* (2006.01)

(52) U.S. Cl. ..... 144/172; 144/174; 144/175; 241/294; 407/41

(58) Field of Classification Search ..... 144/172, 144/175, 174, 162.1, 220, 373, 218, 221, 144/230, 235; 241/277, 278.1, 294, 293, 241/292.1; 407/41, 49, 93, 94, 105, 106
See application file for complete search history.

(56) References Cited

U.S. PATENT DOCUMENTS 5,333,659 A * 8/1994 Carpenter et al. ..... 144/231
5,469,902 A * 11/1995 Sharp et al. ..... 144/241
5,979,522 A * 11/1999 Swartwood et al. ..... 144/176
5,996,655 A * 12/1999 Cramond et al. ..... 144/176

* cited by examiner

*Primary Examiner* — Edward Tolan
*Assistant Examiner* — Matthew G Katcoff
(74) *Attorney, Agent, or Firm* — Fitzpatrick, Cella, Harper & Scinto

(57) ABSTRACT

A clamping assembly to hold a woodworking knife in place in a woodworking machine. The clamping assembly comprises a clamping component comprising a body and an actuator. The body has three discrete contact positions distributed thereon: 1) a fulcrum located generally at one end, 2) a knife abutting portion located generally at the other end, and 3) a bearing surface located elsewhere. The actuator is for applying a clamping force to the body along a clamping axis located intermediate of the knife abutting portion and the fulcrum. The fulcrum is a surface having a normal that is at an angle to the clamping axis. The bearing surface is a surface wherein a line normal to the bearing surface intersects the line normal to the fulcrum at a position outside of the clamping component at a location farther askew of the clamping axis than the fulcrum.

50 Claims, 4 Drawing Sheets

CLAMPING ASSEMBLY FOR WOODWORKING KNIFE

FIELD OF THE INVENTION

The present invention relates generally to the forest industry, and more specifically to woodworking machines used to transform solid wood into lumber, chips, strands, shavings, and veneer. Most particularly the present invention relates to the knife clamping assemblies used to hold woodworking knives in place in such woodworking machines.

BACKGROUND OF THE INVENTION

Many forms of woodworking machines are in use in the forest industry. Some are designed to convert solid wood into a plurality of wood chips for the production of chemical or mechanical pulp. Others are directed to the transformation of wood into chips, veneer, and/or shavings for the production of waferboard, oriented strand board, plywood, lumber, or other such wood products.

Common to such machines is the presence of wood-working knives. The knives can be mounted in various arrangements within the machine to act as required upon the wood being processed. Typically, this involves the mounting of one or more knives on a body of conical, cylindrical, or disc form that is rotated under mechanical or electrical power to cause the knives to act upon the wood in an appropriate fashion. These machines further comprise the means necessary to orient and manipulate the wood against the action of the rotating knives.

With some machines, more than one rotating body may be required to transform the wood in the manner desired. Additionally, with some machine designs, the knives may be maintained in a stationary body while the wood is rotated or otherwise maneuvered against the knives so as to achieve the desired cutting action. What is common with the different arrangements is that the knives are secured to some form of foundation body, or base member, which may be either rotating or stationary, and the knives are brought into relative contact with the wood according to the orientation required to achieve the desired end result.

Common to the aforementioned is that the action of the knives against the wood subjects the knives to considerable cutting forces. The machines must therefore be designed so as to secure the woodworking knives to the base member in a manner to withstand these cutting loads. Since the repeated action of the knives against the wood also results in wear, the machines must also be designed so as to allow for the periodic replacement of the knives. Further, since wood can contain foreign material, such as rock or steel which can be present within the wood itself or embedded or frozen to its exterior, the machine must also be designed so as to allow repairs to be effected in the event of damage to the knives, or other associated machine components.

The most typical means utilized to accomplish the above is to mount the knives in a knife clamping apparatus affixed to the base member. This knife clamping apparatus, often referred to as a knife clamping 'assembly', serves as an intermediate device for securing the knives within the machine. It is generally sized and shaped so as to secure the knives against the cutting forces, allow for their efficient replacement as required, and is typically constructed so as to be mounted to the base member in a fashion that allows for its replacement in the event of damage.

The demands on the clamping assembly are not trivial. Foremost, the clamping assembly must be constructed so that the knives can be retained in their position under the action of the cutting forces. Such cutting forces are typically high in magnitude, extremely episodic, and are usually varied in direction. The clamping assembly must resist deformation, avoid fatigue, and resist breakage when subjected to the stresses associated with these loads. Additionally, the knife clamping assembly must be constructed so as to be of sufficient rigidity so as to minimize deflections such that the knives are not excessively displaced from their proper position within the machine during operation. This latter requirement is important in most woodworking applications where the knife edge must have an accurate location with respect to the wood being processed or other machine components.

The clamping assembly must also be designed so as to allow for the rapid, reliable, and accurate replacement of the knives. Specifically, the apparatus must allow for the knives to be easily removed, the clamping assembly cleaned of any wood debris (flakes, chips, sap, etc.), and replacement knives installed in a repeatable and precise fashion. To achieve this end, the individual components that comprise the clamping assembly should be of a design that permits for a high degree of precision in manufacturing.

Reliability is also of prime importance. In particular, the means employed to clamp and unclamp the knives must be such that a predictable and acceptable mechanical joint is obtained under all circumstances. These means typically comprise some form of actuator of a mechanical or hydraulic nature that can allow the assembly to be opened and closed in a controlled and predictable fashion in order that the knives are properly secured at all times. This actuator, with which the workers must interact to accomplish the changes, should be readily accessible and easy to use.

Since woodworking machines of the type herein described typically operate in a production environment, the design of the clamping assembly must also be such that it is tolerant of the variations that occur under such conditions. This can involve cumbersome working situations where workers need to reach around components of the machine to effectuate a knife change, or limitations in time available between production periods to attend to all aspects of the work in a detailed and thorough fashion. The knife assembly must furthermore exhibit a high degree of fault tolerance so as minor amounts of damage cannot jeopardize the function of the clamping assembly. Such minor damage can easily go unnoticed in a production environment.

To achieve proper integration with the remainder of the machine, the knife clamping assembly must furthermore be of a structure that is compatible with the base member. Such bodies, with their varied forms, impose various geometrical and functional constraints. Foremost it must be sized and shaped to provide for reliable and stable mounting within the base member. Additionally, it must be affixed in a manner that permits for the replacement of components in the event of damage.

The requirements of many modern day machines impose additional demands on the knife clamping assembly. Many such machines are by necessity of function compact in nature. The need to operate at evermore increasing production speeds for cost competitiveness has resulted in machine designs with increasingly higher knife counts, and accordingly, limited amounts of space available for the knives and knife clamping assembly on the base member. Accordingly, knife clamping assemblies, as well as the knives they clamp, must be evermore compact to achieve these goals.

Traditionally, knife clamping assemblies used in woodworking machines have been relatively simple devices occupying significant space on the base members in which they mount. The knives used in these assemblies were commonly large planar elements of simple form that were shaped to allow for the repeated sharpening of the cutting edge. These knives, which due to their size were typically capable of sustaining a significant portion of the cutting loads, were generally secured in the clamping assembly in a 'sandwich' style arrangement using an actuator of some form. The actuator would cause the clamping components of the assembly to be drawn together or otherwise displaced so as to secure the knives therebetween.

Typical with such 'sandwich' style clamping assemblies is that the line of action of the force developed by the actuator intersects with the knife element, often towards its middle section. This often necessitates that the knife be formed to allow for the actuator, commonly a threaded fastener, to pass there through. The advantage of such an arrangement is that the majority, or in many cases all of the clamping force generated by the actuator serves to secure the knife between the clamping components. However as a result of the rather large size of the knife elements themselves, the clamping assemblies are typically bulky devices consuming significant space on the base member.

The advent of so called 'disposable' knives, often of a 'reversible' (or multiple edged) type, has placed increased demands on the clamping assembly. These knives, typically manufactured from higher quality materials, must be small and lightweight for cost effectiveness. Their compact nature precludes them from being primary load bearing elements and renders them significantly more difficult to secure within the clamping assembly.

Blades of the reversible type also pose additional constraints on the clamping assembly in that the clamping components cannot contact the knife is areas adjacent the unexposed cutting edge(s) since these edges can often be damaged from prior use. Already limited due to their smaller size, this further diminishes the support and contact areas that can be employed to maintain the knives in a stable position during operation. Securing such compact knife elements requires that the knives be rigidly clamped with proportionally higher clamping forces than traditional assemblies using larger, regrindable, knife elements.

The most common means to secure knives of a size or a shape that cannot be fastened in a 'sandwich' style configuration is to employ a clamping assembly that functions according to the principle of a third order lever. With this arrangement, the force developed by the actuator is applied to a clamping component which pivots about a fulcrum formed in the assembly. The line of action of the force developed by the actuator is positioned between the fulcrum and the knife. The clamping pressure achieved on the knife is a function of the distances between the fulcrum position, actuator location, and knife contact point according to the principles of a third order lever.

Clamping assemblies that function according to this principle have many advantages. Foremost such an arrangement permits for the line of action of the force generated by the actuator to lie adjacent the knife such that the knife need not be formed to allow the actuator to pass through the knife body itself. This is typically a requirement for securing compact knives, either of disposable, reversible, or regrindable type where the form and size of the knife precludes other clamping means. When properly sized and constructed, clamping assemblies based on this principle can also generate high clamping forces for securing the knives under the action of the cutting forces. Limited only by the space available within the base member, the clamping assembly can typically be sized and shaped to provide for adequate rigidity and sufficient space to accommodate actuators that can develop satisfactory clamping forces so as to be able to secure the knives during operation. Further, simple and reliable third order clamping assemblies can be constructed using only two clamping components and a simple mechanical actuator for securing the knife therebetween.

With such clamping assemblies, the most common configuration is for the actuator to act upon the clamping component positioned towards the outer periphery of the base member. This 'outer' clamping component is generally more accessible and can be more readily opened and closed by workers to effectuate the replacement of the knives. With this arrangement, the remainder of the assembly is affixed to the base member, usually in some form of cavity or 'pocket' sized and shaped for this purpose. The actuator draws the outer clamping component against the knife to secure it within the clamping assembly, which remains stationary with respect to the base member. As this outer clamping component often coincides with the topside of the assembly, this arrangement is commonly referred to as 'topside' clamping.

With the majority of clamping assemblies, the actuator is typically in the form of a threaded fastener such as a screw, a bolt, or a stud and nut combination. Mechanical fasteners of such type are simple, inexpensive, reliable, and can provide significant clamping force in a compact form. In order that the driving features of the fastener be readily accessible, it is most common that these be located on the same face or side of the base member as the outer clamping component. This avoids the need for workers to move to other areas in the machine to access the fasteners when changing knives.

The most common arrangement when using mechanical fasteners for the actuator is to have the fastener pass through the outer clamping member and into other assembly components below, or directly into the base member. When tightened, the fastener is gradually drawn against the outer clamping component to develop the contact force necessary to secure the knives in place. To effectuate a knife change, workers tighten or loosen the fastener as required to either release or secure the knives in the assembly.

As a result of their simplicity and ease of use, third order knife assemblies utilizing a topside clamping configuration and mechanical fasteners are in widespread use in the type of woodworking machines herein described. They are cost effective, versatile, and have proven reliable in service.

However they are not without problems. According to the principles of a third order lever, the clamping pressure achieved on the knife is a function of the force developed by the actuator and the distances between the fulcrum position, actuator location, and contact point between the outer clamping component and the knife. For a given configuration, the clamping pressure developed on the knife is directly proportional to the clamping force developed by the actuator. Should the force developed by the actuator be half of that intended by the designer, the clamping pressure developed on the knife shall similarly be at half the desired value.

Such is often the situation when mechanical fasteners are employed as the actuator. While simple and mechanically reliable, the force developed by the fastener is often difficult to predict and control with accuracy. Such factors as the variation in the fastener's tightening force (torque) and unpredictable nature of friction between contact surfaces result in a wide range of force developed by the fastener.

Further, because of the need for knife assemblies to be of a compact form to integrate properly with the foundation bodies, it is not always possible to achieve a third order configuration that is favourable for the development of high clamping pressures. To do this requires that the fulcrum be positioned far away from the actuator and the knife. With many base members, space constraints limit the placement of the fulcrum. This means that the size of the clamping force, and thereby the ability to carry external cutting loads, is dictated by the capabilities of the actuator, which is often variable and difficult to control as noted above.

In general, the requirement for compactness and high knife clamping pressures conspire to limit the strength that can be obtained with a third order assembly. While the fastener must be of sufficient size to provide the necessary force for securing the knife under the action of the cutting forces, it cannot be of a size or a form that would consume excessive amounts of space within the assembly. This could result in clamping components that are inadequately sized and shaped for acceptable strength to be achieved. While an oversized fastener may ensure that an adequate preload force is developed under all circumstances, it can result in unacceptable stresses within the individual components that comprise the clamping assembly.

To maximize component strength, most third order clamping assemblies securing knives of a compact nature employ smaller high strength fasteners. These fasteners consume less space in the assembly and allow for proportionally stronger clamping components. However achieving adequate function is dependent on the fasteners being tightened to comparatively high values relative to the fastener size. Further, these smaller fasteners lack rigidity which results in a clamping assembly of lower stiffness such that the displacement of the knife edge under the action of the cutting forces can be problematic.

Given that the reliability of most topside clamped third order assemblies is dependent on adequate preload being developed in the fastener, and in particular those using smaller high strength fasteners, it is typically necessary to ensure that factors that influence the clamping force developed by the bolt are controlled in the field. This often mandates that the fasteners be tightened to precise values using specialized equipment, and that the lubrication, cleanliness, and general condition of the fasteners be scrutinized. In the absence of such measures, inadequate bolt preload can compromise the function of the clamping assembly. This can lead to the knives being improperly secured in service.

Alternatives to topside clamped third order clamping assemblies exist. Such designs are often directed at eliminating the aforementioned dependence on adequate preload being developed by the actuator, or to circumvent space limitations on the base member such that high strength arrangements can be achieved.

For example, it is sometimes advantageous to construct assemblies that have the inner clamping component as the member being actuated. With this arrangement, the assembly is affixed and held stationary within a cavity or pocket formed for this purpose on the 'underside' of the base member. The actuator draws the inner clamping component against the knife to secure it in place within the clamping assembly. As with topside clamping arrangements, such underside clamping assemblies also frequently work according to the principles of a third order lever.

One of the main advantages of underside clamping arrangements is that they can often make a more effective use of space within the machine. The clamping assemblies can often be made comparatively larger than their topside mounted counterparts while still maintaining good integration with the base member. This permits for stronger and more rigid components to be constructed, and in the case of third order assemblies, a more favourable configuration for the development of high clamping pressures. Since the cutting forces for most of the woodworking machines herein described are generally directed against the knife from the underside, such underside arrangements are also favourable for reasons of strength and stiffness.

Of late, 'pivot' clamping arrangements that function according to the principles of a first order lever have materialized. With such configurations, the force developed by the actuator is applied to a clamping component which pivots about a fulcrum formed in the assembly. As per the principles of a first order lever, the line of action of the force developed by the actuator is located askew of both the fulcrum and the knife thereby allowing knives of a compact nature to be secured. However, unlike third order levers, the fulcrum's location is between the actuator and the contact point on the knife. When in use, the actuator pivots the clamping component about the fulcrum to secure the knife in place.

Such pivot clamping arrangements allow for favourable first order configurations to be achieved such that a high percentage of the actuator's force can be applied to the knife. This permits the actuator, typically a threaded fastener, to be made smaller or fewer in number while achieving the high preload force desired. This further allows the individual clamping components that comprise the assembly to be made rigid yielding an assembly of high overall stiffness. Since the line of action of the force developed by the actuator is also askew of the knife, such arrangements are generally well suited for securing knives of a compact nature. An example of such a first order pivot clamping assembly can be found in U.S. Pat. No. 5,996,655 to CAE Machinery Ltd.

While the aforementioned alternatives offer advantages in the form of stronger more rigid clamping assemblies that are less susceptible to inadequate preload being developed by the actuator, they suffer from some notable disadvantages as well. In general, such assemblies do not exhibit the same high ease of use as simple third order clamping assemblies constructed from two clamping components. As a result of reduced accessibility or added complexity, it can be more difficult for workers to make a knife change, in particular to clean the assembly of any wood debris. Such material, if left in place, could compromise the function and reliability of the assembly.

Pivot style arrangements and underside clamping configurations are also generally of a form that preclude their use in many types of woodworking machines. Generally as a result of their size and shape, they do not integrate well with all forms of base members and cannot be easily retrofitted to existing machines. This precludes their use in many applications for which their advantages would in general be beneficial.

Further, the drive for cost competitiveness has also pushed manufacturers to adopt more standardized knife assembly designs that can be applied to a broad spectrum of woodworking machines. Standardized knife clamping assembly designs are advantageous for the producer and consumer alike. The producer benefits from greater economies of scale that allow for production efficiencies. The consumer benefits from reduced component costs and fewer knife assembly components being required in inventory to support more than one type of woodworking machine in the production facility.

SUMMARY OF THE INVENTION

What is therefore required is an improved 'top' clamping assembly for the clamping of compact knives that overcomes one or more of the aforementioned problems. It is preferably compact and of a form that it can be readily adapted to many types of wood working machines. Further it is preferably of high strength to allow for knife elements of a compact nature to be rigidly secured to the base member at all times. It is preferably of simple design so that the components and actuator that comprise its structure are of reliable construction and are cost effective to produce. Further, it preferably provides for high ease of use such that replacement of the knives can be accomplished swiftly, reliably, and in a safe manner.

The present invention accomplishes the above by utilizing a novel seating arrangement for at least one of the clamping components whereby the position and orientation of the contact surfaces are distributed over three discrete positions such that increased mechanical advantage results. The preferred form of the invention is further configured to take advantage of frictional forces to improve the ability of the clamping assembly to withstand loads that arise during use.

By forming clamping components according to the present invention knife clamping assemblies can be constructed that are favourably sized and shaped such that they can be applied to many different types of woodworking machines. This permits a standardized clamping assembly to be used in many applications while providing for a compact design with high reliability. The preferred form of the invention also provides for a clamping assembly that is easy to use, allowing for the fast and efficient rotation or replacement of knives having worn or damaged edges while permitting the clamping components to be of rigid construction and of simple shape such that they are cost effective to produce.

Therefore, according to one aspect of the present invention there is provided a clamping assembly for clamping one or more knife elements onto a woodworking machine, said clamping assembly comprising:

a clamping component comprising a body, said body being sized and shaped to have three discrete contact positions distributed on said body, said three discrete contact positions comprising a fulcrum located generally at one end, a knife abutting portion located generally at the other end for abutting said one or more knife elements, and a bearing surface located elsewhere; and an actuator for applying a clamping force to said body along a clamping axis located intermediate of said knife abutting portion and said fulcrum;

said fulcrum being formed as a substantially planar surface wherein a line normal to said fulcrum is at an angle to said clamping axis;

said bearing surface being formed as a substantially planar surface positioned on said body wherein a line normal to said bearing surface intersects said line normal to said fulcrum at a position outside of said clamping component at a location farther askew of said clamping axis than said fulcrum.

According to another aspect of the present invention there is provided a clamping component for use in securing one or more knife elements onto a base member of a wood working machine, said clamping component comprising:

a body sized and shaped to have at least three discrete contact positions distributed on said body, said three discrete contact positions comprising, (1) a fulcrum located generally at one end, (2) a knife abutting portion, located generally at the other end, for abutting said one or more knife elements, and (3) a bearing surface located elsewhere on said body;

said body further including an opening through said body, said opening having an axis located intermediate of said knife abutting portion and said fulcrum;

said fulcrum being formed as a substantially planar surface wherein a line normal to said substantially planar surface is positioned at an angle to said axis of said opening.

In yet another aspect of the present invention, there is provided a clamping assembly for clamping one or more knife elements onto a woodworking machine, said clamping assembly comprising:

a clamping component sized and shaped to have at least three discrete contact positions, said discrete contact positions comprising a fulcrum located generally at one end, a knife abutting portion located generally at the other end for abutting said one or more knife elements, and a bearing surface located elsewhere; and an actuator for applying a clamping force along a clamping axis located intermediate of said knife abutting portion and said fulcrum;

said fulcrum being formed wherein the application of said clamping force results in a reaction force developed at said fulcrum having a line of action that is at an angle to said clamping axis;

said bearing surface being sized, shaped, oriented, and positioned wherein the application of said clamping force results in a reaction force developed at said bearing surface having a line of action that intersects with said line of action of said reaction force developed at said fulcrum at a position outside of said clamping component at a location farther askew of said clamping axis than said fulcrum.

In yet a further aspect of the present invention, there is provided a clamping assembly for clamping one or more knife elements onto a base member of a woodworking machine, said clamping assembly comprising:

first and second clamping components for securing said one or more knife elements therebetween, said first clamping component abutting said second clamping component at least at one location;

said first clamping component being sized and shaped to have three distinct contact positions, said distinct contact positions comprising, (1) a fulcrum located generally at one end, (2) a knife abutting portion, located generally at the other end, for abutting said one or more knife elements, and (3) a bearing surface located elsewhere; and an actuator for applying a clamping force to said first clamping component along a clamping axis located intermediate of said knife abutting portion and said fulcrum;

said fulcrum being formed as a substantially planar surface wherein a line normal to said substantially planar surface is at an angle to said clamping axis;

said bearing surface being sized, shaped, oriented, and positioned wherein a line normal to said bearing surface intersects said line normal to said fulcrum at a position outside of said first clamping component at a location farther askew of said clamping axis than said fulcrum.

In one preferred embodiment the clamping assembly is formed of a first clamping component, a second clamping component and an actuator for securing one or more knife elements therebetween, wherein the first clamping component abuts the second clamping component at a fulcrum and the first clamping component pivots about the fulcrum under the action of the clamping force applied by the actuator. A bearing surface, sized, shaped, oriented and positioned on the first clamping component to cooperate with the fulcrum abuts the second clamping component so as to develop increased mechanical advantage and resist unclamping forces generated by the interaction of the one or more knife elements with the wood being processed. In another embodiment the bearing surface of the first clamping component abuts a base member, or alternately other components attached to the base member.

BRIEF DESCRIPTION OF THE DRAWINGS

Reference will now be made, by way of example only, to preferred embodiments of the invention as depicted in the attached drawings, in which.

DETAILED DESCRIPTION OF THE PREFERRED EMBODIMENTS

Figure 1:
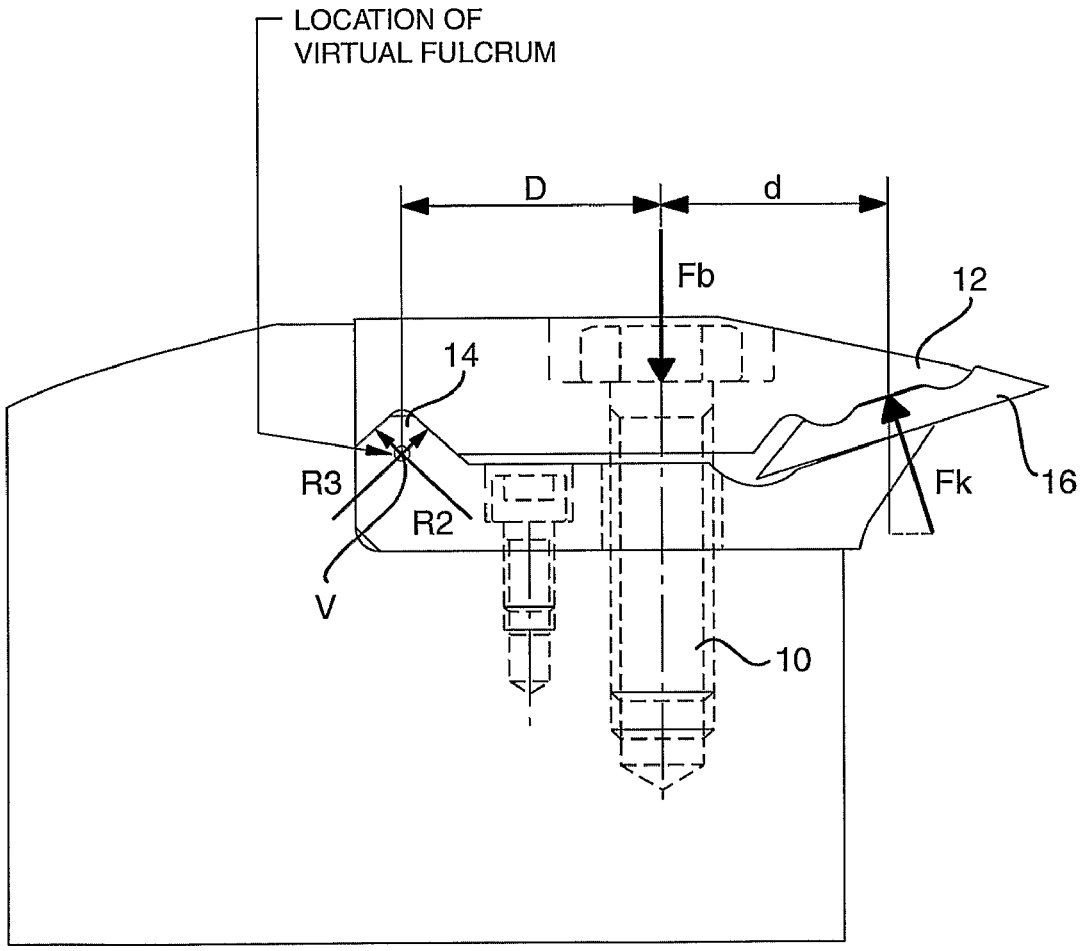
PRIOR ART Fig 1
FIG. 1 is view of a typical prior art clamping assembly.

FIG. 1 shows a typical prior art knife clamping assembly constructed according to the principles of a third order lever. With this arrangement, the force developed by an actuator, in the form of a screw 10, is applied to a clamping component 12 which pivots about a fulcrum 14 formed in the assembly. The line of action of the force developed by the screw 10, shown as Fb, is positioned between the fulcrum 14 and the location where the clamping component 12 abuts a knife element 16.

As can be seen in FIG. 1, the fulcrum 14 is formed of two opposing inclined surfaces that allow the actuated clamping component 12 to be engaged, or interlocked, with the member which it abuts. The two opposing inclined surfaces allow the clamping component 12 to pivot under the action of the force developed by the screw 10 but restrict its movement in a direction parallel to and perpendicular to the line of action of the force developed by the screw 10. As a result of the shape of the fulcrum 14, clamping component 12 cannot slide in a direction that is orthogonal to the line of action of the screw 10.

As per the principles of a third order lever, the force applied to the knife element 16 under the action of the force developed by the screw 10 is a function of the distance between the fulcrum position, screw location, and contact point with the knife element 16. Most specifically, this force is a function of the distance between the line of action of the screw 10 and the fulcrum 14 and the distance between the line of action of the screw 10 and the location where clamping component 12 abuts knife element 16. In FIG. 1, these distances are illustrated as 'D' and 'd' respectively.

Key to the understanding the present invention is the point at the fulcrum 14 about which the distance D is determined. In order to establish the fraction of the force developed by the screw 10 that is applied to the knife element 16, it is necessary to examine the forces developed at the fulcrum 16. While with most third order arrangements this point will coincide closely with the physical location in which the actuated clamping component pivots, analysis of the present invention will show that this not necessarily be so.

Shown in FIG. 1 are the two reaction forces, R2 and R3, developed at each of the opposing inclined surfaces which comprise the fulcrum 14 under the action of the force Fb developed by the screw 10. For the sake of simplifying the analysis, friction is not considered and the reaction forces R2 and R3 are considered to pass through the centre of these surfaces which would coincide with the approximate centre of pressure. Although this simplified approach is taken in the interest of clarity, the present arguments apply equally to the situation where friction is considered as a later discussion will show.

Considering the case of no friction, the line of action of forces R2 and R3 developed at the fulcrum 14 will be normal to the surfaces and will be directed to resist the force developed by the screw 10. Turning to FIG. 1, it can be seen that the line of action of these reaction forces R2 and R3 intersect at a point in space that is intermediate the opposed inclined surfaces comprising the fulcrum 14. This point is identified in the figure as 'V'.

Examination of point V reveals that only the forces developed by the screw 10 and the reaction force developed at the knife element 16, shown as Fk, can act to pivot clamping component 12 about this point. Reaction forces R2 and R3 cannot act to rotate clamping component 12 about this position since their lines of action pass through this location. Accordingly, point V represents the position about which the distance D should be measured to determine the fraction of the force developed by the screw 10 that must be resisted by the knife element 16. This point can therefore be conveniently considered as a 'virtual fulcrum' since it is about this point which the laws of a third order lever apply.

Although prior art clamping assemblies functioning according to the principles of a third order lever exist having varied shapes and forms, the fraction of the force developed by the actuator that is applied to the knife element is dictated by how far askew the virtual fulcrum is positioned from the actuator. The greater the distance the virtual fulcrum is located from the line of action of the force developed by the actuator, the greater the fraction of the actuator's force that will be applied to the knife element. This defines the mechanical advantage of the clamping assembly. Greater mechanical advantage results as the distance the virtual fulcrum is located askew of the line of action of the force developed by the actuator is increased.

Figure 2:
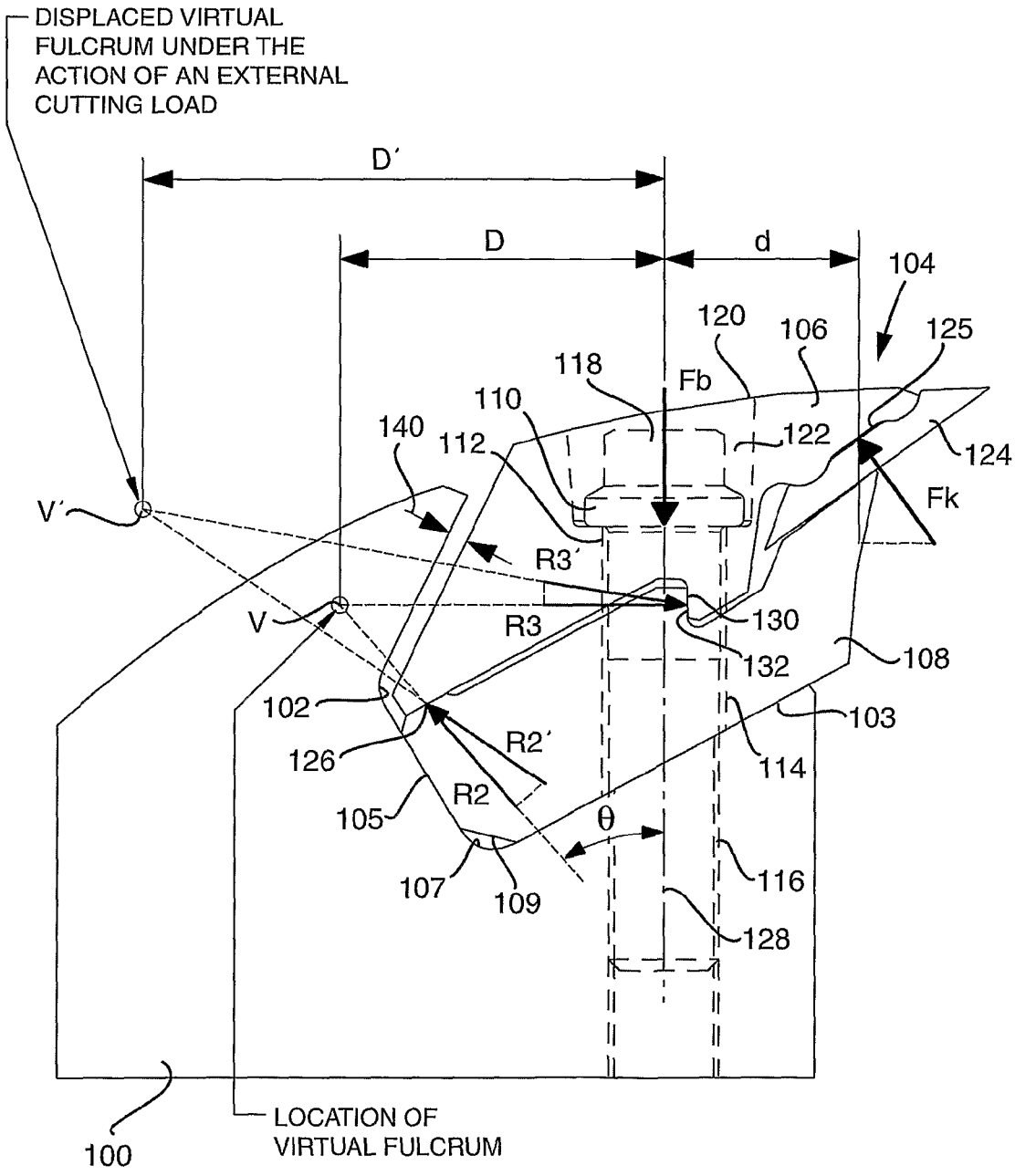
FIG. 2 is a view of a first embodiment of the present invention.

Turning to FIG. 2, a first embodiment of the present invention is shown. A base member 100 forming a rotatable foundation body of a woodworking machine of cylindrical form is shown. For ease of reference only a part of base member 100 is illustrated. It will be understood that the present invention may be applied to many different types of woodworking machines with foundation bodies of conical, cylindrical, or disc form and showing base member 100 as a cylindrical segment is by way of example only. Further, base members as described herein may also be stationary as it will be understood that the current invention comprehends stationary base members where the wood is maneuvered in an appropriate fashion to achieve the desired end result.

Within base member 100 is formed a pocket 102 into which a clamping assembly 104 is inserted. The clamping assembly 104 includes a rear clamping component 106 and a front clamping component 108. In this specification, the terms rear and front are used to describe their position relative to the direction of movement of the base member 100 with respect to the wood being processed (not shown). Front clamping component 108 is positioned towards the direction of movement of clamping assembly 104 whereas rear clamping component 106 is positioned away from the direction of movement. In this specification the terms front and rear are to be read interchangeably with the terms inner and outer since the front clamping component is positioned towards the inside of base member 100 which comprises the rotating cylindrical body.

Within pocket 102 is affixed inner clamping component 108 using means (not shown) that result in it being rigidly connected to base member 100. Forming part of pocket 102 is a bottom support face 103 and a rear support face 105 for abutting the corresponding contact surfaces on inner clamping component 108. Located between support faces 103 and 105 is a radiused corner 107 present for stress reduction reasons. To permit the inner clamping component to achieve flush engagement with support surfaces 103 and 105, a chamfer 109 is provided on inner clamping component 108 between the two orthogonal surfaces abutting base member 100. Although abutting inner clamping component 108, it will be noted that pocket 102 is formed such that outer clamping component 106 is free of contact with any of the faces of pocket 102 such that a gap 140 is present between base member 100 and outer clamping component 106.

Clamping assembly 104 further includes an actuator for actuating outer clamping component 106. In this embodiment, the actuator is a threaded fastener in the form of a screw 110 with a head 118, which most preferably is located within a recess 122 formed in the outer surface 120 of outer clamping component 106. The screw 110 passes through openings 112 and 114 in outer clamping component 106 and inner clamping component 108 respectively and is threaded into threads 116 formed in base member 100. While a threaded screw 110 is shown as the actuator, it will be understood that the present invention comprehends other clamping means, such as hydraulic mechanisms, electro mechanical actuators and the like.

Secured within the clamping assembly 104 is a compact knife element 124 which is illustrated as a 'reversible' (or indexable) type having two opposed cutting edges. The knife element 124 is shown clamped between the outer clamping component 106 and the inner clamping component 108 generally at one end. At the other end of the clamping assembly 104 a fulcrum 126 is located. The fulcrum 126 forms a point about which outer clamping component 106 can pivot which along with the knife abutting portion 125, form discrete positions for supporting outer clamping component 106 under the action of the screw 110. Reflecting a third order lever arrangement, the screw 110 is positioned between the fulcrum 126 and knife element 124.

Also present within the assembly are a bearing surface 130 on outer clamping component 106 and an opposing contact surface 132 on inner clamping component 108 about which bearing surface 130 abuts. Along with fulcrum 124 and the knife abutting portion 125 of outer clamping component 106, bearing surface 130 comprises a third discrete position about which contact with adjoining members occurs. It will be noted that these contact points are positioned at separate spaced apart locations on outer clamping component 106 with each having specific functions as will be explained in greater detail below.

When tightened, the head 118 of screw 110 is gradually drawn against outer clamping component 106 such that a clamping force is developed. This force, shown as Fb in FIG. 2, is directed against outer clamping component 106 along a line of action that is parallel with the axis of the screw. This axis, indicated at 128 and defined as the clamping axis, coincides with the line of action of the clamping force developed by the actuator.

During tightening, the clamping force Fb developed by the screw 110 is resisted at both ends of outer clamping component 106 by a reaction force developed against the knife element 124, shown as Fk, and a reaction force developed against the fulcrum 126, shown as R2. Reaction force Fk acts to secure knife element 124 against inner clamping component 108 which is secured within pocket 102 of base member 100. It will be noted that bearing surface 130, formed as a substantially planar surface oriented mainly parallel to clamping axis 128, cannot offer any resistance to clamping force Fb.

Due to the geometry, if there were no bearing surface 130 abutting opposing contact surface 132 on inner clamping component 108, the force of the screw 110 would cause the outer clamping component 106 to move rearward, specifically deeper into the pocket 102. This is due to the fact that the contact surface comprising the fulcrum 126 is substantially planar and is inclined relative the direction in which the clamping force Fb is applied. This inclination, indicated by the angle θ formed between the line of action of reaction force R2 and the direction in which clamping force Fb is applied, is approximately 30 degrees in this embodiment.

Although the knife abutting end 125 is contoured such that it engages knife element 124 at its backside, the front side of knife element 124 is shaped such that it does not engage inner clamping component 108 in a fashion that would positively restrict its movement. In this manner, outer clamping component 106 is, at either end, free to slide relative to inner clamping component 108 when a clamping force is applied along clamping axis 128. This natural tendency to slide is resisted by the presence of the bearing surface 130 abutting opposing contact surface 132 on inner clamping component 108. Because of the presence of bearing surface 130 and the opposing contact surface 132 on inner clamping component 108, instead of sliding, a further reaction force arises, which is shown as R3.

Unlike the prior art assembly illustrated in FIG. 1, it will be noted that fulcrum 126 is not formed to engage or interlock the inner clamping component 108. While shaped to allow outer clamping component 106 to pivot, the substantially planar surface comprising the fulcrum 126 is not formed to positively resist forces acting along its face. Due to the shape and orientation of fulcrum 126 relative to the clamping axis 128, fulcrum 126 cannot balance the reaction forces that develop against outer clamping component 106. Most specifically, the component of the clamping force Fb and reaction force Fk directed along the surface of fulcrum 126 must be resisted elsewhere if a state of equilibrium is to be achieved.

Accordingly, fulcrum 126 can be considered as 'unbalanced' since it lacks the ability to counteract the reaction forces that develop on outer clamping component 106 under the action of the screw 10, or equally, under an externally applied force directed against the knife element 10 that acts in this direction. This contrasts with the 'balanced' arrangement of the prior art device of FIG. 1 that occurs when the pivot point is formed as two opposed inclined surfaces or other alternate forms that result in the actuated clamping component remaining stable in the clamping assembly under the action of the clamping force or any externally applied loads.

Returning to FIG. 2, examination of the structure of inner clamping component 108 and knife element 124 shows that these elements also lack the ability for the knife abutting end of outer clamping component 106 to counteract forces directed along fulcrum 126. Accordingly, the component of the clamping force along this face, or any external loads that are applied to the knife element 124 that act in this direction, must be resisted elsewhere in the assembly.

Preferably this is accomplished by utilizing a separate bearing surface suitably sized, shaped, oriented, and positioned to resist loads that cannot be borne elsewhere. Most importantly, this bearing surface is strategically positioned to increase the mechanical advantage achieved with the clamping assembly. By appropriately sizing, shaping, positioning and orienting the bearing surface on the actuated clamping component such that it cooperates with a separate fulcrum that has similarly been appropriately sized, shaped, oriented, and positioned, increased mechanical advantage can be obtained as will be explained below.

That the projections of the lines of action of force R2 and force R3 intersect at a point V outside of clamping component 106. The lines of action are once again illustrated as being normal to the contact features acting through their approximate centre of pressure as would be the case where friction is absent. Again, while this is done for the purposes of simplification, the present arguments apply equally to the situation where friction is present as a later analysis will demonstrate.

As can be seen in FIG. 2, the location of the point V lies outside of the outer clamping component 106 at a distance farther askew of clamping axis 128 than is located the fulcrum 126. As was the case for the prior art device illustrated in FIG. 1, this distance is shown in FIG. 2 as 'D'. Similarly, the distance between the reaction force Fk on knife element 124 and clamping axis 128, is shown as 'd'.

It will be noted that point V represents the location where the only forces that can act to pivot outer clamping component 106 about this point are the clamping force Fb and reaction force Fk developed at the knife abutting portion 125 contacting knife element 124. Reaction forces R2 and R3 cannot act to rotate outer clamping component 106 about this position since their lines of action pass through this location.

A static force analysis conducted about this point reveals that the fraction of the clamping force applied against knife element 124 by the outer clamping component 106 is dictated by the distances D and d in accordance with the principles of a third order lever. Location V can therefore be considered as a 'virtual fulcrum' about which outer clamping component 106 does not physically rotate, but about which the fraction of the clamping force applied to knife element 124 can be determined in accordance with the laws of a third order lever.

Figure 3:
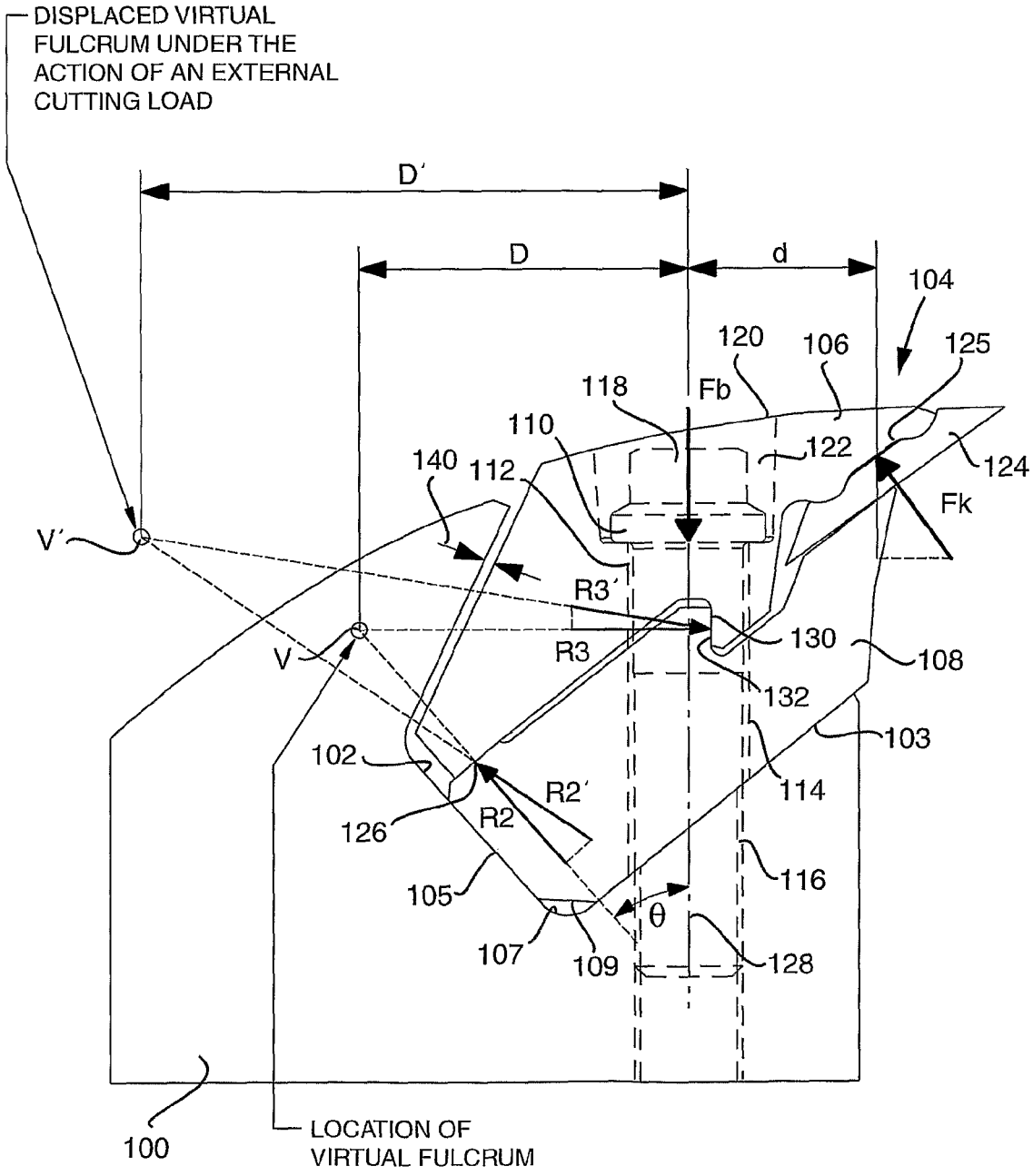
FIG. 3 is a variation of the embodiment of FIG. 2.

Accordingly, the clamping assembly can be analogized as being a modified third order lever arrangement. However unlike traditional clamping assemblies working according to this principle, the current preferred clamping assembly utilizes a fulcrum 126 that is purposely formed such that the reaction force R2 developed at the fulcrum 126 does not cause the outer clamping component 106 to achieve a state of equilibrium. While the outer clamping component 106 pivots about the fulcrum 126 in an analogous fashion to the prior art device shown in FIG. 1, an additional reaction force is required for the forces to be balanced. This is accomplished by having bearing surface 130 oriented and positioned with respect to fulcrum 126 such that the reaction force R3 in combination with reaction force R2 yield an effective or virtual fulcrum location V that is farther askew of the knives 124 than is the fulcrum 126 itself. Preferably, this is achieved in part by positioning the bearing surface 130 away from the fulcrum 126 in a direction parallel to clamping axis 128 on the knife abutting portion side of the fulcrum 126. In other words, if a dividing plane is defined which, (1) is perpendicular to the clamping axis 128, and (2) passes through the fulcrum 126, the plane has two sides, with the knife abutting portion 125 being on one side of the plane (i.e. on the knife abutting portion side of the plane). The bearing surface 130 is positioned away from the fulcrum 126 on the same side of the plane as the knife abutting portion 125. In the embodiment of FIGS. 2 and 3, the surface 130 is positioned in the direction of outer surface 120 of outer clamping component 106. This is towards the 'outside' periphery of the clamping assembly 104, as shown in FIG. 2.

As per the principles of a third order lever, for a given distance d, the clamping force Fk developed by the outer clamping component 106 abutting against knife element 124 will increase as distance D is made larger. With the current invention, the virtual fulcrum V is positioned at a distance D that is greater than is achieved when the fulcrum is formed and oriented such that the reaction forces are balanced at the physical fulcrum itself. Accordingly, increased mechanical advantage results that is above and beyond that which is attainable with traditional third order configurations such as with the prior art device shown in FIG. 1.

Turning to FIG. 3, a variation on the first embodiment of the present invention is shown. In this embodiment the elements and structure are analogous to those shown in FIG. 2, except that the angle θ formed between the clamping axis 128 and the substantially planar surface forming fulcrum 126 is 40 degrees rather than 30 degrees. Since the operation and workings of this embodiment is otherwise generally the same as that of FIG. 2, it will not be described in any more detail herein.

Comparing the embodiments of FIGS. 2 and 3, it will be noted that the orientation and position of the fulcrum 126 in FIG. 3 is such that the line of action of reaction force R2 results in the position of the virtual fulcrum 'V' being located farther askew of clamping axis 128. This provides for increased mechanical advantage over the embodiment of FIG. 2 since the distance D is larger. Accordingly, under the action of a given clamping force Fb, a greater reaction force Fk is developed at the knife abutting end 125 for securing knife element 124 against inner clamping component 108.

It can now be understood how the angle θ formed between clamping axis 128 and the substantially planar surface comprising fulcrum 126 develops mechanical advantage. By forming the fulcrum 126 as a substantially planar surface oriented at an angle with respect to clamping axis 128, the line of action of the reaction force R2 can be directed away from clamping axis 128. For a given placement and orientation of bearing surface 130, the virtual fulcrum V will be located farther askew of clamping axis 128 as angle θ is increased. If angle θ is too small, too little mechanical advantage will be achieved to make it worthwhile. It is therefore preferred to make the angle θ at least twenty degrees, with even more advantage being achieved with an angle of thirty degrees or more. However, the present invention is not limited to any specific minimum angle, although angles below twenty degrees are less preferred and angles below 10 degrees are much less preferred.

Figure 4:
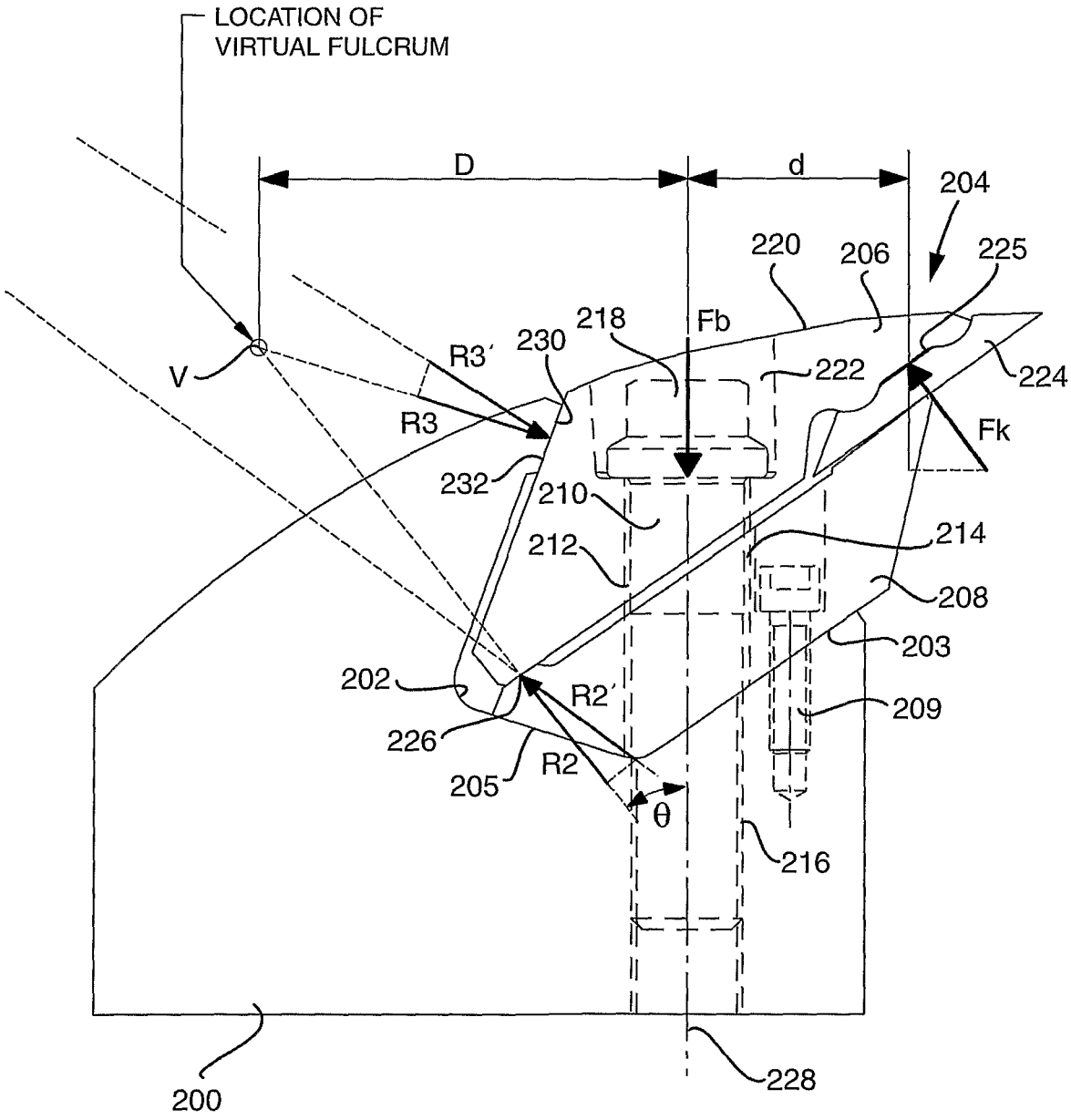
FIG. 4 is a second embodiment of the present invention.

Turning now to FIG. 4 a further embodiment of the present invention is shown. In this embodiment there is a portion of a base member 200, also illustrated as a portion of a rotatable cylindrical body including a pocket 202 in which a clamping assembly 204 is located. Clamping assembly 204 includes an outer clamping component 206 and an inner clamping component 208, which as with the previous embodiments, is indicative of the position of the components relative to the axis of rotation of base member 200. Specifically outer clamping component 206 is located towards the periphery of the pocket away from the point about which base member 200 rotates coinciding with the 'top' of knife clamping assembly 204.

Within pocket 202, inner clamping component 208 is seated against a bottom support face 203 and a back support face 205. A screw 209 is provided for rigidly affixing inner clamping component 208 into the pocket 202 of base member 200.

Clamping assembly 204 further includes a means for actuating outer clamping component 206, which like in the previous embodiments, is in the form of a screw 210. The screw 210 passes through openings 212 and 214 in outer clamping component 206 and inner clamping component 208 respectively and is threaded into threads 216 formed in base member 200. A head 218 comprising the driving features of the screw 210 is placed within a recess 222 formed in the outer surface 220 of the outer clamping component 206. Locating the head 218 within the recess 222 such that it does not protrude beyond the periphery of outer surface 220 is preferred since it can be free of any potential contact with the wood being processed or other machine elements during operation.

Secured within clamping assembly 204 is a knife element 224 in the form of a compact cutting blade of a reversible, double edged design. Knife element 224 is shown clamped between the outer clamping component 206 and the inner clamping component 208 generally at one end. While a cutting blade of compact form is illustrated, the current invention comprehends knife elements of other forms and sizes where the knife element is held clamped by the actuated clamping component at a location that is askew of the clamping axis.

At the other end of outer clamping component 206, a fulcrum 226 is located about which outer clamping component 204 pivots under the action of the screw 210. As with the previous embodiments, the screw 210 is positioned between the fulcrum 226 and the knife element 224. Although fulcrum 226 is shown abutting inner clamping component 208, it will be understood that the current invention comprehends the fulcrum abutting other members such as the base member, or alternately, additional components attached there between.

Also present on outer clamping component 206 is a bearing surface 230 on the outer clamping component 206 for abutting an opposing contact surface 232. Unlike the previous embodiments the opposing contact surface 232 is not located on the inner clamping component 208, but instead is located on one of the rear faces of pocket 202 formed in base member 200. Although the opposing contact surface 232 is formed on base member 200, it will be understood that the current invention comprehends contact surface 232 being formed on other components located intermediate base member 200 and outer clamping component 206 in which bearing surface 230 may abut.

By rotating the screw 210, the head 218 can be brought to bear against, or displaced away from, outer clamping component 206 such that a clamping force is developed or diminished depending on whether the screw is being tightened or loosened. In FIG. 4 this force is illustrated as Fb and is shown to act along a clamping axis 228 that is coincident with the axis of the screw 210.

By tightening or loosening screw 210 outer clamping component 206 can be moved between an open position and a closed position for the installation or replacement of knife element 224 as required. While a threaded fastener in the form of a screw is shown, it will be understood that the present invention comprehends other clamping means, such as hydraulic or pneumatic mechanisms and the like, that apply an appropriate clamping force along the clamping axis by engaging the actuated clamping component.

In a fashion analogous to the previous embodiments, the application of a clamping force Fb to outer clamping component 206 is resisted at both ends by a reaction force developed against the knife element 224 shown as Fk and a reaction force developed against the fulcrum 226, shown as R2. As for the previous embodiments, these forces are shown acting normal to the features that comprise the contact surfaces and passing through their approximate centers of pressure. Due to the geometry, if there were no bearing surface 230 abutting opposing contact surface 232, the force of the screw 210 would cause the outer clamping component 206 to move rearward, specifically deeper into the pocket 202. This is due to the inclination of substantially planar surface comprising the fulcrum 226 relative to the direction in which clamping force Fb is applied and the fact that the inner and outer clamping components 206 and 208, and knife element 224, are formed such that outer clamping component 208 can slide at both ends, namely, at the fulcrum 226 and at the end comprising the knife abutting portion 125. This inclination, indicated in FIG. 4 by the angle θ formed between the clamping axis 228 and line of action of reaction force F2, is about 35 degrees.

With the present invention this natural tendency to slide is resisted by the presence of bearing surface 230 abutting the opposing contact surface 232 on the base member 200. Because of the presence of the bearing surface 230 and opposing contact surface 232, instead of sliding, in the present invention a further reaction force arises at this position, which is shown as R3. Reaction force R3 acting at bearing surface 230 allows the outer clamping component to achieve a state of equilibrium. While a single bearing surface in the form of a substantially planar surface has been described for the preferred embodiments, it will be understood that the present invention comprehends other forms of bearing surfaces. Further, the present invention also comprehends the use of more than one bearing surface such as two adjacent coplanar surfaces or multiple parallel planar surfaces slightly offset one with respect to another.

As shown in FIG. 4, the projections of the lines of force R2 and R3 intersect at a point 'V', which is again described as a virtual fulcrum. As with the previous embodiments, it will be noted that the virtual fulcrum V is located outside of the clamping components, at a distance 'D' from clamping axis 228. The distance between the reaction force Fk developed at the knife element 224 and the clamping axis 228 is again shown as 'd'.

The function of this embodiment is analogous to those shown in FIGS. 2 and 3. However in this embodiment, the bearing surface 230 is positioned on base member 200 at a location and orientation that result in a very favourable position for the virtual fulcrum V. Most specifically, the position of the virtual fulcrum V is located farther askew of the clamping axis than in the previous embodiments. This provides for increased mechanical advantage so as under the action of a given clamping force Fb, a greater reaction force Fk is developed against knife element 224 such that greater external cutting forces can be borne by knife element 224 during operation.

An advantage of the invention can now be understood. By utilizing three discrete contact positions on the actuated clamping component, and appropriately forming, orienting, and positioning the contact surfaces relative to the axis about which the clamping force is developed, favourable mechanical advantage can result. This is accomplished by separating the contact surfaces not abutting the knife element into two discrete positions that are formed and oriented so that lines of force that develop through these locations intersect at a point as far askew of the knife element as possible. For a given distance between the actuator and the knife abutting portion 225, increasing the distance between this point and the knife element will result in a greater portion of the force developed by the actuator being applied to the knife element.

For the preferred embodiments shown, this is achieved by forming the bearing surface and the fulcrum as substantially planar surfaces positioned at two separate spaced apart locations. The fulcrum is inclined with respect to the clamping axis and is positioned as far askew of the clamping axis as is practicable. To develop mechanical advantage, the bearing surface is oriented such that it does not bear any portion of the clamping force. It is positioned as distant of the fulcrum as possible in a direction opposite, specifically in a direction parallel to the clamping axis and to the same side as the knife abutting portion 125. The bearing surface is further orientated such that a line normal to the bearing surface intersects a line normal to the fulcrum at a location farther askew the clamping axis than the fulcrum. It will be understood that the direction of the lines normal to the surfaces are to be taken as outward opposite to the direction in which reaction forces through these surfaces can act.

To maximize the mechanical advantage that will result, the inclination of the fulcrum should be maximized and the angle formed between the substantially planar surfaces comprising the fulcrum and bearing surface should be minimized. For the embodiments of FIGS. 2 and 3, this latter angle is 70 degrees and 60 degrees respectively. With the embodiment of FIG. 4, the angle formed between the substantially planar surfaces comprising the fulcrum and bearing surface has been further reduced by inclining the bearing surface with respect to the clamping axis. For the embodiment of FIG. 4, the angle achieved is approximately 35 degrees.

For the preferred embodiments described herein, the mechanics of the arrangement have been explained using the concept of a 'virtual fulcrum'. This allows for a direct comparison with prior art assemblies constructed according to the principles of a third order lever with which the current invention has now shown to improve. As has been explained, through an appropriate choice of form, position and orientation for the two discrete contact positions through which reaction forces R2 and R3 act, it is possible to locate the virtual fulcrum outside of the actuated clamping component at a position farther askew of the knife element than could be achieved with a traditional balanced fulcrum formed within the clamping assembly. This allows the clamping components comprising the assembly to be made more compact and of higher strength than with a third order lever arrangement pivoting about a traditional balanced fulcrum.

The location of the virtual fulcrums V for each of the embodiments is shown in each of the figures. As previously explained, these locations correspond to those that occur in the absence of friction. As is evident in the drawings, the locations of the virtual fulcrums lie outside of the knife assembly entirely and are farther askew of the knife element than is the position where the actuated clamping component pivots in the assembly.

An additional and important advantage of the present invention is that utilizing three discrete contact positions as herein described makes for a favourable use of friction. Specifically, friction at the bearing surface and fulcrum with the corresponding surfaces with which they abut increases the overall load bearing capabilities of the assembly. This advantage is not present with knife assemblies that function according to the principles of a third order lever where the actuated clamping component pivots about a traditional balanced fulcrum formed in the assembly.

The advantageous use of friction can best be understood by examining the impact of friction on the location of the virtual fulcrum. Under the action of an external load directed against the knife element, displacements within the components result in the actuated clamping component pivoting about the unbalanced fulcrum formed in the assembly. Movement at the fulcrum and bearing surface is resisted by friction such that the lines of action of the reaction forces R2 and R3 are shifted to lie in a direction shown in the figures as R2' and R3'. Accordingly this displaces the virtual fulcrum farther askew of the clamping axis resulting in increased in mechanical advantage and the ability for the knife assembly to carry higher external loads for a given actuator clamping force. The attached figures illustrate the effect of friction on displacing the virtual fulcrum farther askew of the knife under the action of an external load. In FIGS. 2 and 3, the 'displaced' virtual fulcrums are shown as V'. However with the embodiment of FIG. 4, it will be noted that the location of the displaced virtual fulcrum is such that the distance D becomes significantly large such that almost infinite mechanical advantage results.

A further benefit of the invention can be achieved by positioning the bearing surface on the actuated clamping component such that the reaction force R3 is at a location 'forward' of the fulcrum, specifically at a point that is less askew of the knife abutting portion 125 than the location about which the actuated clamping component pivots. Preferably, this location should be as close to the knife abutting portion 125 as possible and as distant from the pivot location as is achievable. The embodiments of FIG. 2 and FIG. 3 illustrate such a configuration where the bearing surface has been located askew of the clamping axis in a direction towards the knife abutting portion 125.

The advantage in this specific arrangement is that it results in a construction that provides for higher stiffness and strength of the clamping assembly. The combination of three discrete contact positions according to the present invention with the further idea of positioning the bearing surface forward of the unbalanced fulcrum results in an arrangement where the actuated clamping component can be 'interlocked' with the remainder of the assembly. This interlocking configuration results in a rigid connection between the actuated clamping component and the remainder of the clamping assembly. Under the action of the cutting loads, the displacements of the actuated clamping component are thereby minimized such that the overall stiffness of the knife clamping assembly is increased. This addresses a limitation typical of traditional third order clamping assemblies where the rigidity of the actuator, usually low relative to the remainder of the components, results in a clamping assembly of low stiffness. This offers the further advantage that the actuator is subject to a much smaller portion of the external cutting loads.

As can now be understood, by forming the actuated clamping component to use three discrete contact positions according to the present invention, it is possible to construct a knife clamping assembly with such favourable characteristics as:

High strength. Utilizing three discrete contact positions as herein described results in increased mechanical advantage relative to prior art third order configurations. A greater portion of the clamping force developed by the actuator is applied to the knife element.

Compactness. Because the current invention affords increased mechanical advantage, the clamping assembly can be made more compact than traditional third order designs.

Rigidity. By using three discrete contact positions for the actuated clamping component, the overall stiffness of the assembly can be made high. The rigidity of the actuator, typically lower than the individual clamping components, is less important in the overall stiffness characteristics of the assembly. This ensures that the knife element is not excessively displaced from its intended location within the machine when subjected to external loads.

High reliability. The combination of increased mechanical advantage and a favourable use of friction yield a high external load carrying capability for a given actuator clamping force. This allows the knife assembly to function acceptably over a wide range of actuator preloads.

High ease of use. Since the outer (or 'top') member of the clamping assembly can be the member actuated, it is possible to achieve a high ease of use all while achieving adequate mechanical strength and reliability. Further, the increased mechanical advantage afforded by the concept allows for the size or the quantity of actuators to be minimized.

Simplicity. The three discrete contact positions as herein described allows for simple and cost effective knife clamping assemblies to be constructed from just two components.

Standardization. The present concept allows for favourable shapes to be achieved for the knife clamping assembly such that a single standardized design can be utilized in many types of woodworking machines. Further, the present invention affords versatility in that a common compact design can be integrated with foundation bodies of various forms such that the knife assembly can be retrofitted to many existing or new devices.

While preferred embodiments of the invention have been described above, it will be understood by those skilled in the art that many variations and alterations are possible without departing from the broad scope of the invention as described and drawn. For example, while a single mechanical fastener in the form of a screw is shown as the actuator in the preferred embodiments, it will be understood that clamping assemblies comprising one or more fasteners is comprehended by the invention. Similarly, while a single knife element has been described, the current invention comprehends the clamping of multiple knife elements in a single assembly. Additionally, while the preferred embodiments show the outer clamping component as the actuated component, the invention comprehends clamping assemblies where the inner clamping component is actuated and the outer clamping component is affixed to the base member. Other variations will also be apparent to those skilled in the art.

The invention claimed is:

1. A clamping assembly for clamping one or more knife elements onto a woodworking machine, said clamping assembly including:

a clamping component comprising a body having two ends and opposed sides, said body being sized and shaped to have three discrete contact positions distributed on said body, said three discrete contact positions comprising a surface defining a fulcrum located generally at one end of the body, a surface defining a knife abutting portion located generally at the other end of the body for abutting said one or more knife elements, and a bearing surface located on said body separate from said fulcrum and between the fulcrum and the knife abutting portion; said surfaces defining said fulcrum and said knife abutting portion being located on the same side of said body and an actuator for applying a clamping force to said body along a clamping axis located intermediate of said knife abutting portion and said fulcrum;

said fulcrum being formed as a substantially planar surface wherein a line normal to said fulcrum is at an acute angle $\Theta$ to said clamping axis;

said bearing surface being formed as a substantially planar surface positioned on said body such that a line normal to said bearing surface intersects said line normal to said fulcrum at a position outside of said clamping component at a location farther askew of said clamping axis than said fulcrum, whereby the fulcrum and bearing surface support the clamping component against the clamping force applied by the actuator and the reaction forces at the fulcrum and bearing surface oppose the clamping force.

2. The clamping assembly of claim 1, wherein said angle is at least 20 degrees.

3. The clamping assembly of claim 1, wherein said angle is at least 30 degrees.

4. The clamping assembly of any one of claim 1, 2, or 3, wherein said knife abutting portion is positioned askew of said clamping axis.

5. The clamping assembly of claim 4, wherein said bearing surface is positioned away from said fulcrum, and on the same side of a dividing plane as said knife abutting portion, the dividing plane being perpendicular to said clamping axis, and passing through said fulcrum.

6. The clamping assembly of claim 5 wherein said line normal to said bearing surface and said line normal to said fulcrum form an angle of 70 degrees or less.

7. The clamping assembly of claim 6 wherein said bearing surface is positioned askew of said clamping axis in a direction towards said knife abutting portion.

8. The clamping assembly of claim 6 wherein said line normal to said bearing surface is substantially perpendicular to said clamping axis.

9. The clamping assembly of claim 6 wherein said clamping assembly further includes a second clamping component.

10. The clamping assembly of claim 9 wherein said bearing surface abuts a surface on said second clamping component to limit movement of the body relative to said second clamping component in a direction generally parallel to said surface defining said fulcrum.

11. The clamping assembly of claim 10 wherein said fulcrum abuts another surface on said second clamping component.

12. The clamping assembly of claim 6 wherein said actuator comprises at least one threaded fastener.

13. The clamping assembly of claim 12 wherein said at least one threaded fastener engages said clamping component body to develop said clamping force.

14. A clamping component for use in securing one or more knife elements onto a base member of a woodworking machine, said clamping component comprising:

a body, having two ends and opposite sides and being sized and shaped to have at least three discrete contact positions distributed on said body, said three discrete contact positions comprising, (1) a surface defining a fulcrum located generally at one end of the body, (2) a knife abutting portion, located generally at the other end of the body, for abutting said one or more knife elements, and (3) a bearing surface located on said body separate from said fulcrum and between the fulcrum and the knife abutting portion, said surfaces defining said fulcrum and said knife abutting portion being located on the same side of said body;

said body further including an opening through said body, said opening having a clamping axis located intermediate of said knife abutting portion and said fulcrum;

said fulcrum being formed as a substantially planar surface wherein a line normal to said substantially planar surface is positioned at an acute angle $\Theta$ to said clamping axis of said opening; and said bearing surface being formed as a substantially planar surface positioned on said body such that a line normal to said bearing surface intersects said line normal to said fulcrum at a position outside of said clamping component at a location farther askew of said clamping axis than said fulcrum, whereby the fulcrum and bearing surface support the clamping component against the clamping force applied by the actuator and the reaction forces at the fulcrum and bearing surface oppose the clamping force.

15. A clamping component for use in securing one or more knife elements onto a base member of a woodworking machine as claimed in claim 14, wherein said angle ⊖ is at least twenty degrees.

16. A clamping component for use in securing one or more knife elements onto a base member of a woodworking machine as claimed in claim 14, wherein said angle ⊖ is at least thirty degrees.

17. A clamping component for use in securing one or more knife elements onto a base member of a woodworking machine as claimed in any one of claim 14, 15, or 16, wherein said knife abutting portion is positioned askew of said clamping axis of said opening.

18. A clamping component for use in securing one or more knife elements onto a base member of a woodworking machine as claimed in claim 17, wherein said bearing surface is positioned away from said fulcrum and on the same side of a dividing plane as said knife abutting portion, the dividing plane being perpendicular to said clamping axis of said opening and passing through said fulcrum.

19. A clamping component for use in securing one or more knife elements onto a base member of a woodworking machine as claimed in claim 18, wherein said bearing surface is positioned askew of said clamping axis of said opening in a direction towards said other end.

20. A clamping component for use in securing one or more knife elements onto a base member of a woodworking machine as claimed in claim 18, wherein said line normal to said bearing surface and said line normal to said fulcrum form an angle that is 70 degrees or less.

21. A clamping component for use in securing one or more knife elements onto a base member of a woodworking machine as claimed in claim 20, wherein said line normal to said bearing surface is substantially perpendicular to said axis of said opening.

22. A clamping assembly for clamping one or more knife elements onto a woodworking machine, said clamping assembly including:

a clamping component having two ends and opposite sides and being sized and shaped to have at least three discrete contact positions, said discrete contact positions comprising a surface portion defining a fulcrum located generally at one end of the body, a surface defining a knife abutting portion located generally at the other end of the body for abutting said one or more knife elements, and a bearing surface located on said clamping component separate from said fulcrum and between the fulcrum and the knife abutting portion; said surfaces defining said fulcrum and said knife abutting portions being located on the same side of said body; and an actuator for applying a clamping force along a clamping axis located intermediate of said knife abutting portion and said fulcrum;

said fulcrum being formed such that the application of said clamping force results in a reaction force developed at said fulcrum having a line of action that is at an acute angle ⊖ to said clamping axis;

said bearing surface being sized, shaped, oriented, and positioned wherein the application of said clamping force results in a reaction force developed at said bearing surface having a line of action that intersects with said line of action of said reaction force developed at said fulcrum at a position outside of said clamping component at a location farther askew of said clamping axis than said fulcrum, said bearing surface being formed as a substantially planar surface positioned on said body such that a line normal to said bearing surface intersects said line normal to said fulcrum at a position outside of said clamping component at a location farther askew of said clamping axis than said fulcrum, whereby the fulcrum and bearing surface support the clamping component against the clamping force applied by the actuator and the reaction forces at the fulcrum and bearing surface oppose the clamping force.

23. A clamping assembly for clamping one or more knife elements onto a woodworking machine as claimed in claim 22, wherein said angle is at least 20 degrees.

24. A clamping assembly for clamping one or more knife elements onto a woodworking machine as claimed in claim 22, wherein said angle is at least 30 degrees.

25. A clamping assembly for clamping one or more knife elements onto a woodworking machine as claimed in any one of claim 22, 23, or 24, wherein said knife abutting portion is positioned askew of said clamping axis.

26. A clamping assembly for clamping one or more knife elements onto a woodworking machine as claimed in claim 25, wherein said bearing surface is positioned away from said fulcrum, and on the same side of a dividing plane as said knife abutting portion, the dividing plane being perpendicular to said clamping axis, and passing through said fulcrum.

27. A clamping assembly for clamping one or more knife elements onto a woodworking machine as claimed in claim 26, further including a second clamping component.

28. A clamping assembly for clamping one or more knife elements onto a woodworking machine as claimed in claim 27, wherein said bearing surface abuts a surface on said second clamping component.

29. A clamping assembly for clamping one or more knife elements onto a woodworking machine as claimed in claim 28, wherein said fulcrum abuts another surface on said second clamping component.

30. A clamping assembly for clamping one or more knife elements onto a woodworking machine as claimed in claim 26, further including a base member wherein said bearing surface abuts said base member.

31. A clamping assembly for clamping one or more knife elements onto a base member of a woodworking machine, said clamping assembly comprising:

first and second clamping components for securing said one or more knife elements therebetween, said first clamping component abutting said second clamping component at least at one location;

said first clamping component having two ends and opposite sides and being sized and shaped to have three distinct contact positions, said distinct contact positions comprising, (1) a surface defining a fulcrum located generally at one end of the first clamping component, (2) a surface defining a knife abutting portion, located generally at the other end of the first clamping component, for abutting said one or more knife elements, and (3) a bearing surface located on said first clamping component separate from said fulcrum and between the fulcrum and the knife abutting portion; said surfaces defining said fulcrum and said knife abutting portion being located on the same side of said body; and an actuator for applying a clamping force to said first clamping component along a clamping axis located intermediate of said knife abutting portion and said fulcrum;

said fulcrum being formed as a substantially planar surface such that a line normal to said substantially planar surface is at an acute angle ⊖ to said clamping axis;

said bearing surface being sized, shaped, oriented, and positioned wherein a line normal to said bearing surface intersects said line normal to said fulcrum at a position outside of said first clamping component at a location farther askew of said clamping axis than said fulcrum, said bearing surface being formed as a substantially planar surface positioned on said body such that a line normal to said bearing surface intersects said line normal to said fulcrum at a position outside of said first clamping component at a location farther askew of said clamping axis than said fulcrum, whereby the fulcrum and bearing surface support the first clamping component against the clamping force applied by the actuator and the reaction forces at the fulcrum and bearing surface oppose the clamping force.

32. The clamping assembly of claim 31, wherein said angle is at least 20 degrees.

33. The clamping assembly of claim 31, wherein said angle is at least 30 degrees.

34. The clamping assembly of any one of claim 31, 32 or 33, wherein said knife abutting portion is positioned askew of said clamping axis.

35. The clamping assembly of claim 34, wherein said bearing surface is positioned away from said fulcrum, and on the same side of a dividing plane as said knife abutting portion, the dividing plane being perpendicular to said clamping axis, and passing through said fulcrum.

36. The clamping assembly of claim 35, wherein said bearing surface is formed as a substantially planar surface.

37. The clamping assembly of claim 36, wherein said line normal to said bearing surface and said line normal to said fulcrum form an angle of 70 degrees or less.

38. The clamping assembly of claim 37, wherein said line normal to said bearing surface is substantially perpendicular to said clamping axis.

39. The clamping assembly of claim 37, wherein said first clamping component abuts said second clamping component at said fulcrum and said first clamping component pivots about said fulcrum under the action of said clamping force applied by said actuator.

40. The clamping assembly of claim 37, wherein said second clamping component is affixed to said base member and said first clamping component is moveable between an open position and a closed position for securing said one or more knife elements therebetween.

41. The clamping assembly of claim 37, wherein said first clamping component comprises a rear clamping component and said second clamping component comprises a front clamping component.

42. The clamping assembly of claim 37, wherein said first clamping component comprises a front clamping component and said second clamping component comprises a rear clamping component.

43. The clamping assembly of claim 37, wherein said base member further includes a pocket for affixing said second clamping component, said pocket comprising at least one contact surface for abutting said second clamping components.

44. The clamping assembly of claim 37, wherein said bearing surface abuts said second clamping component.

45. The clamping assembly of claim 37, wherein said bearing surface abuts said base member.

46. The clamping assembly of claim 37, wherein said base member is a rotatable body of cylindrical, conical, or disc form.

47. The clamping assembly of claim 37, wherein said actuator is in the form of at least one threaded fastener.

48. The clamping assembly of claim 47, wherein said at least one threaded fastener engages said first clamping component to develop said clamping force.

49. The clamping assembly of claim 48, wherein said at least one threaded fastener passes through a corresponding opening in at least one of said clamping components.

50. The clamping assembly of claim 49, wherein said at least one threaded fastener fits into a corresponding recess at least on one of said clamping components.

* * * * *